US006968622B2

(12) United States Patent
Ping

(10) Patent No.: US 6,968,622 B2
(45) **Date of Patent: *Nov. 29, 2005**

(54) UTILITY KNIFE

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 20 days.

This patent is subject to a terminal disclaimer.

(21) Appl. No.: 10/750,134

(22) Filed: Dec. 31, 2003

(65) Prior Publication Data

US 2004/0226173 A1 Nov. 18, 2004

Related U.S. Application Data

(63) Continuation-in-part of application No. 10/437,089, filed on May 13, 2003.

(51) Int. Cl.[7] ..... B26B 1/04

(52) U.S. Cl. ..... 30/156; 30/155; 30/159; 30/160; 30/330; 30/331

(58) Field of Search ..... 30/155, 156, 159, 30/160, 161, 329–333, 337, 339, 340

(56) References Cited

U.S. PATENT DOCUMENTS

| | | | |
|---|---|---|---|
| 97,154 A | 11/1869 | Barnard | |
| 493,075 A | 3/1893 | Evertz | |
| 515,045 A | 2/1894 | Bultzingslowen | |
| 584,077 A | 6/1897 | Jackson | |
| 596,096 A | 12/1897 | Watts | |
| 988,068 A | 3/1911 | Beardsley | |
| 1,362,142 A | 12/1920 | Rohrer | |
| 1,444,324 A | 2/1923 | Brooks | |
| 1,706,251 A | 3/1929 | Perry | |
| 1,750,577 A | 3/1930 | DeBracht | 30/295 |
| 2,134,973 A | 11/1938 | Harwell | |
| 2,265,775 A | 12/1941 | Mc Namara | |
| 2,284,128 A | 5/1942 | Bush | |
| 2,523,575 A | 9/1950 | Kassel | |
| 2,914,850 A | 12/1959 | Kuhnl | |
| 2,980,996 A | 4/1961 | Beran | |
| 3,306,297 A | 2/1967 | Voorhees | |
| 3,568,315 A | 3/1971 | Smith | |
| 3,593,417 A | 7/1971 | West | |
| 3,872,591 A | 3/1975 | Quenot | |
| 4,017,969 A | 4/1977 | Stonebraker | |
| 4,040,181 A | 8/1977 | Johnson | |
| 4,261,104 A | 4/1981 | Cuscovitch | |
| 4,347,665 A | 9/1982 | Glesser | |
| 4,442,600 A | 4/1984 | Felix-Salichow | |
| 4,570,341 A | 2/1986 | Konneker | |

(Continued)

FOREIGN PATENT DOCUMENTS

CN 02-2-88379.7 12/2002

(Continued)

*Primary Examiner*—Allan N. Shoap
*Assistant Examiner*—Carolyn Blake
(74) *Attorney, Agent, or Firm*—Joseph J. Previto

(57) ABSTRACT

A utility knife having a handle and a blade holder which is pivotally mounted on the handle for movement from an unfolded position to a folded position. The handle has a space adapted to receive the blade holder when the blade holder is in its folded position. The blade holder includes a main wall and guard wall pivotally mounted on the main wall to pivot from an open position to a closed position overlying the main wall. The main wall being adapted to hold a blade so that a blade is interposed between the main wall and guard wall when the guard wall is in its closed position.

20 Claims, 3 Drawing Sheets

U.S. PATENT DOCUMENTS

| | | | |
|---|---|---|---|
| 4,604,805 | A | 8/1986 | Krieger |
| 4,665,615 | A | 5/1987 | Martinez |
| 4,669,188 | A | 6/1987 | Evrell |
| 4,719,700 | A | 1/1988 | Taylor, Jr. |
| 4,805,303 | A | 2/1989 | Gibbs |
| 4,811,486 | A | 3/1989 | Cunningham |
| 4,920,644 | A | 5/1990 | La Gattuta |
| 4,936,014 | A | 6/1990 | Shaanan et al. |
| 5,044,079 | A | 9/1991 | Gibbs |
| 5,095,624 | A | 3/1992 | Ennis |
| 5,125,157 | A | 6/1992 | Howard |
| 5,400,509 | A | 3/1995 | Collins |
| 5,511,310 | A | 4/1996 | Sessions |
| 5,769,094 | A | 6/1998 | Jenkins, Jr. |
| 5,815,927 | A | 10/1998 | Collins |
| 5,826,340 | A | 10/1998 | Hull |
| 5,909,930 | A | 6/1999 | Ragland |
| 5,966,816 | A | 10/1999 | Roberson |
| 5,979,059 | A | 11/1999 | Leatherman |
| 6,170,104 | B1 | 1/2001 | Seber |
| 6,170,158 | B1 | 1/2001 | Daily |
| 6,256,887 | B1 | 7/2001 | Osborne |
| 6,256,888 | B1 | 7/2001 | Shuen |
| 6,263,581 | B1 | 7/2001 | Forte |
| 6,354,007 | B1 | 3/2002 | Scarla |
| 6,370,778 | B1 | 4/2002 | Conable |
| 6,446,341 | B1 | 9/2002 | Wang |
| 6,487,740 | B2 | 12/2002 | Seber |
| 6,574,868 | B1 | 6/2003 | Overholt |
| 2002/0059730 | A1 | 5/2002 | Flavigny |

FOREIGN PATENT DOCUMENTS

| | | |
|---|---|---|
| WO | WO90086633 | 8/1990 |

UTILITY KNIFE

RELATED APPLICATION

This is a continuation-in-part of U.S. patent application Ser. No. 10/437,089 filed May 13, 2003.

BACKGROUND

The present invention relates to a utility knife and more particularly to a foldable utility knife in which the blade may be folded into the handle when the knife is not in use.

Utility knives have been used for a number of years. Some of the utility knives in use have blades that are mounted on a blade holder which is foldable within a handle when the knife is not in use. However, some of these utility knives have many movable parts which makes them difficult to use and expensive to manufacture. In addition, in some of these utility knives replacement of the blade is a complicated operation any may require special tools.

OBJECTS

The present invention overcomes these problems and has for one its objects the provision of an improved utility knife in which the blade holder may be easily folded into a handle.

Another object of the present invention is the provision of an improved utility knife in which the blade is held securely on the utility knife.

Another object of the present invention is the provision of an improved utility knife in which improved means are provided for replacing the blade on the utility knife.

Another object of the present invention is the provision of an improved utility knife which is simple to use and inexpensive to manufacture and maintain.

Other and further objects of the invention will be obvious upon an understanding of the illustrative embodiment about to described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
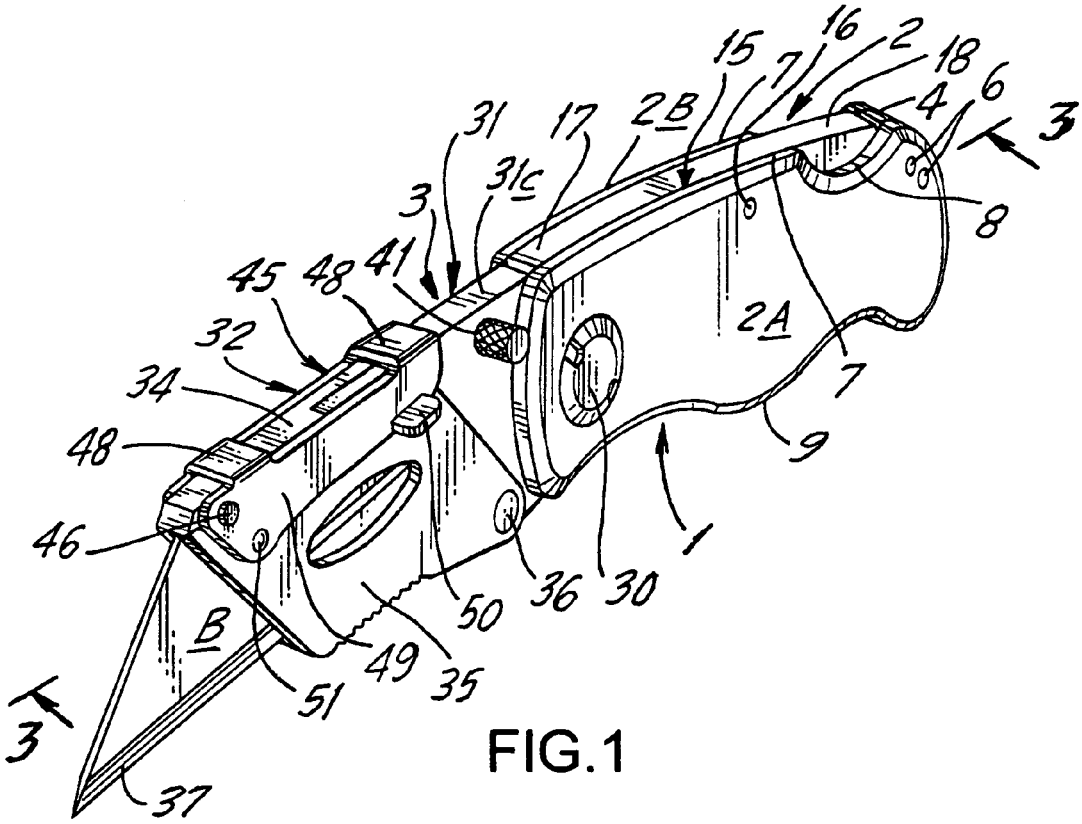
FIG. 1 is a perspective view of a utility knife made in accordance with the present invention.
Figure 2:
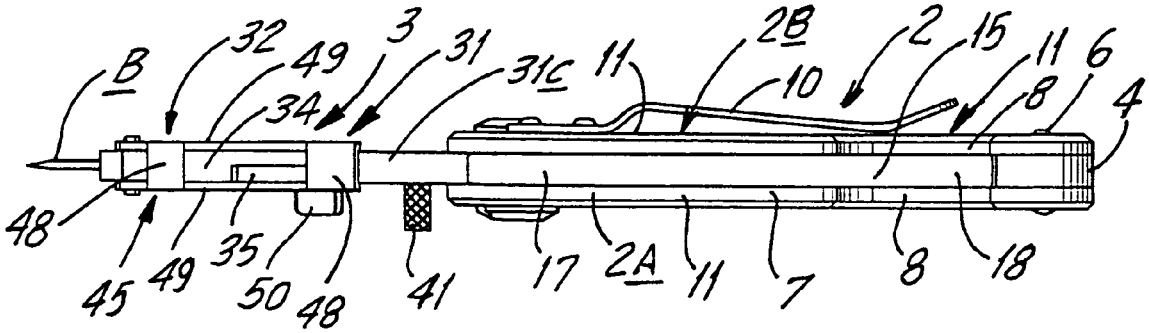
FIG. 2 is a top plan view thereof.

Referring to the drawings, the utility knife 1 of the present invention comprises a handle 2 and a blade holder 3.

The handle 2 comprises a pair of handle halves 2A and 2B each having an outer side wall 11 an upper edge 7 and a lower edge 9. A rear spacer 4 is provided between the handle halves 2A and 2B to maintain the handle halves 2A and 2B separated and to create a space 5 between handle halves 2A and 2B. The spacers 4 and the handle halves 2A and 2B are held together by fasteners 6 which pass through the spacer 4 and the handle halves 2A and 2B in order to hold them together. The upper edge 7 of the handle halves 2A and 2B (i.e. the handle 2) has a finger notch 8 and the lower edge 9 of the handle halves 2A and 2B (i.e. the handle 2) may be undulated in order to permit the user's fingers to grip the handle 2. If desired, a clip 10 may be mounted on a side wall 11 of the handle halves 2A and/or 2B to permit the utility knife 1 to be fastened onto the user's belt or other convenient place.

Figure 3:
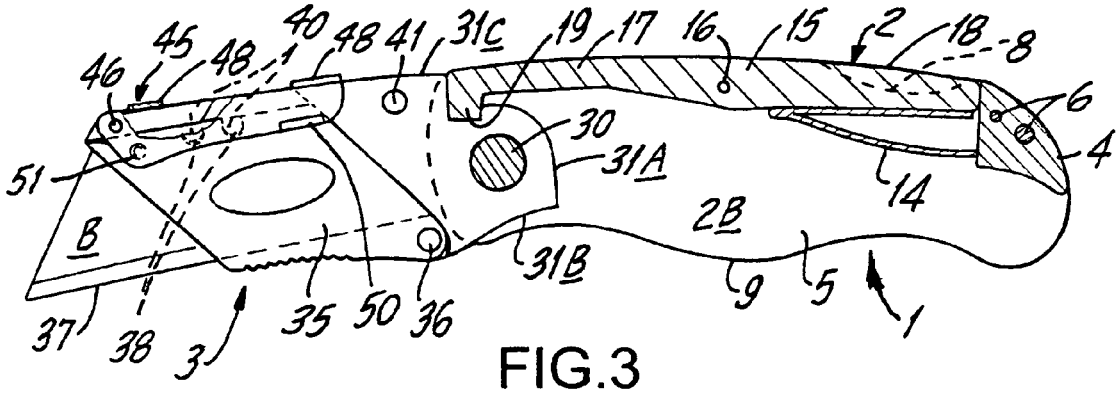
FIG. 3 is a sectional view taken along the line 3—3 of FIG. 1.

Interposed between the handle halves at 2A and 2B and along the upper edges 7 of the handle halves 2A and 2B there is provided a lock lever assembly 15 (FIGS. 3 to 5) which is pivotally mounted between the handle halves 2A and 2B on a pivot pin 16 which extends through the two handle halves 2A and 2B and the lock lever assembly 15. The lock lever assembly 15 is a two arm lever having front and rear arms 17 and 18, respectively. The front arm 17 is provided with a downwardly extending lock finger 19. Below the rear arm 18 of the lock lever assembly 15 there is provided a spring 14 (which is v-shaped or u-shaped) which normally bears against the bottom edge of the rear arm 18 to force the rear arm 18 upwardly and the front arm 17 downwardly around the pivot 16 so that rear arm 18 protrudes above the notch 8. It will be seen that when the rear arm 18 of the lock lever assembly 15 is pressed down manually through the notch 8 against the action of spring 14, the front arm 17 will be raised.

The blade holder 3 of the present invention comprises a rear end 31 and a front end 32 which are integral with each other.

The rear end 31 of the blade holder 3 has rear edge 31A bottom edge 31B and upper edge 31C. The blade holder 3 is pivotally mounted in the space 5 between handle halves 2A and 2B on a pivot pin 30. A finger knob 41 may be provided on the rear end 31 to facilitate the pivotal movement of the blade holder 3 relative to the handle 2. The upper edge 31C of the rear end 31 has a groove 33 into which the downwardly extending lock finger 19 of the lock assembly 15 is adapted to enter when the blade holder 3 is in its extended or unfolded position.

The front end 32 of the blade holder 3 comprises a thin main wall 34 and a thin guard wall 35 pivotally mounted on the main wall 34 on pivot pin 36. The main wall 34 is adapted to hold a blade B which has a lower cutting edge 37 and spaced notches 38 in its upper edge 39. The main wall 34 has a pair of spaced protrusions 40 extending therefrom into which the upper notches 38 of the blade B are adapted to enter to hold the blade B in place on the main wall 34. It will be seen that when the guard wall 35 is in its closed raised position it covers and holds the blade B in place but when it is in its open downward position, it exposes the blade B.

Figure 6:
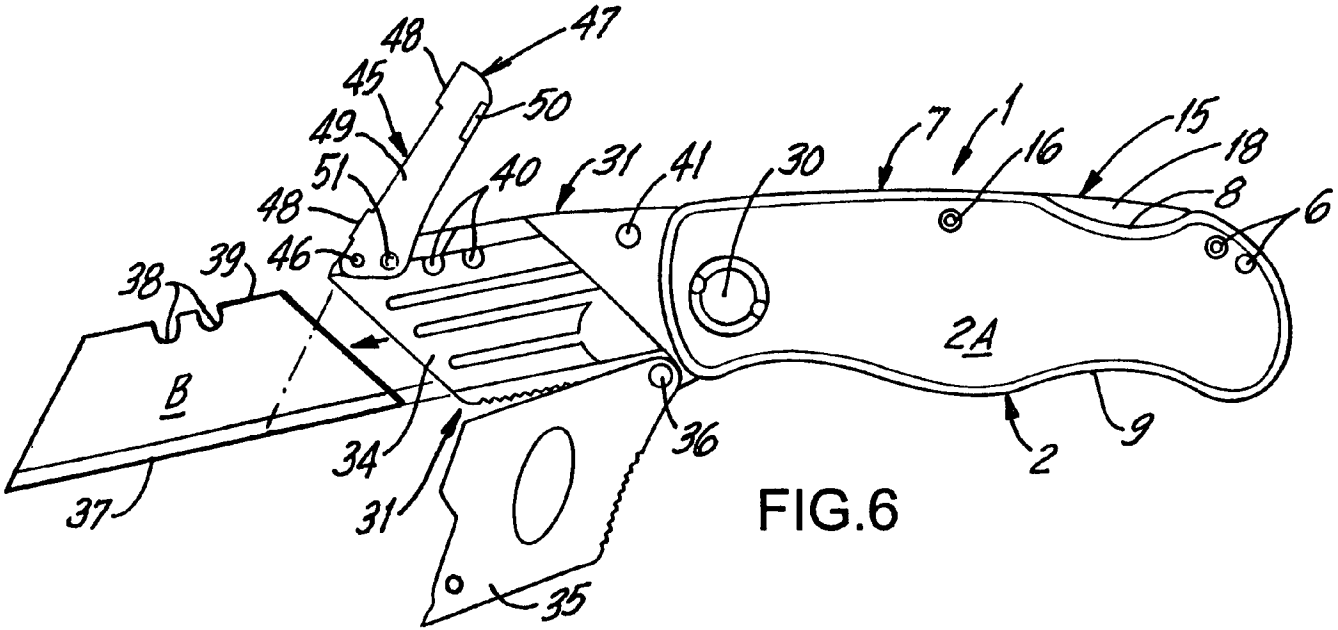
FIG. 6 is a plan view of one side of the utility knife showing the manner of removing and replacing the blade.
Figure 7:
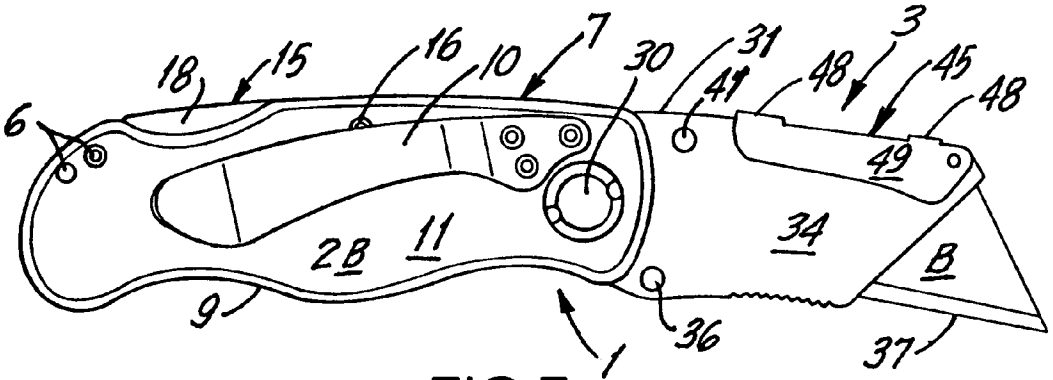
FIG. 7 is a plan view of the opposite side of the utility knife.

A blade lock assembly is mounted along the top edge 35 of the blade holder 3 and is pivotally mounted on the front end 32 of the blade holder 3 on pivot pin 46. The blade lock assembly 45 is in the form of a u-shaped clip having a segmented or interrupted top wall 48, a pair of side walls 49 depending from the top wall 48 and a side finger tab 50 extending outwardly therefrom. When the blade lock assembly or clip 45 is pivoted downwardly around pivot 46, its side walls 49 straddle the walls 34 and 35 of the blade holder 3 and its top wall 48 overlies the walls 34 and 35 as well as the blade B in order to lock the blade B in place. Inwardly extending pimples 51 may be provided in the side walls 49 to frictionally engage the main and guard walls 34–35 to hold the lock assembly 45 in place. When it is desired to remove and replace the blade B, the clip 45 is pivoted upwardly by means of its finger tab 50 to release the walls 34–35 and the blade B. This permits the guard wall 35 to be pivoted away from the blade B (as shown in FIG. 6) in order to expose the blade B and permit the blade B to be removed and replaced.

In operation of the utility knife 1, the utility knife is placed in its operative unfolded position with the blade holder 3 unfolded and ready to be used. The blade B is held on the main wall 34 by protrusions 40 extending into notches 38 in the top edge 39 of the blade B. The lock finger 19 of the front arm 17 of the lock lever assembly 15 is in its lower position (because of the pressure of spring 14 on rear arm 18) and is positioned in the groove 33 in the blade holder 3 in order to hold the blade holder 3 in its unfolded position. The rear arm 18 of the lock lever assembly 15 is in its raised position and protrudes above the finger notch 8 at the top edge 7 of the handle 2.

Figure 4:
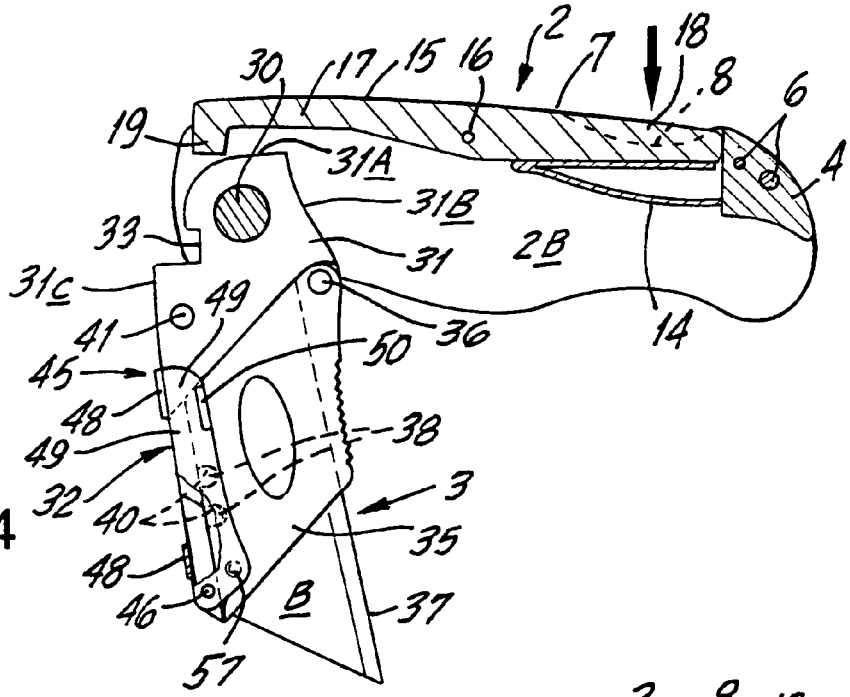
FIG. 4 is a sectional view similar to FIG. 3 showing the utility knife in a partially folded position.
Figure 5:
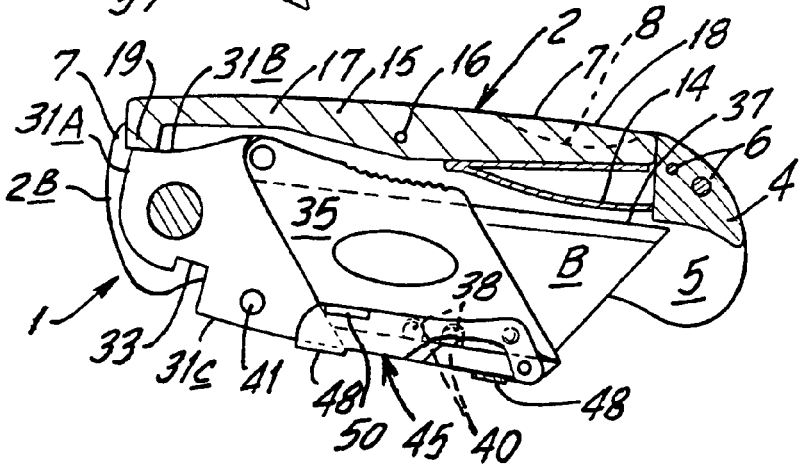
FIG. 5 is a sectional view similar to FIG. 3 showing the utility knife in a fully folded position.

When it is desired to place the utility knife 1 into its folded inoperative position, the rear arm 18 of the lock assembly 15 is pressed down manually through the notch 8 against the bias of the spring 14. This causes the front arm 17 of the lock assembly 15 to be raised thereby moving the lock finger 19 out of the groove 33 to release the blade holder 3 and permit it to pivot downwardly around the pivot pin 30 (FIG. 4). This may be accomplished by pushing down on the finger grip 41. The blade holder 3 is then pivoted down completely into the space 5 between the handle halves 2A and 2B (FIG. 5). When pressure on rear arm 18 is released, the spring 14 moves the rear arm 18 back to its original raised position by the tension of the spring 14. This causes the lock finger 19 to bear against the rear edge 31 A and lower edge 31 B of the blade holder 3 thereby holding the blade holder 3 in its folded position.

When it is desired to use the blade B, the reverse procedure is followed. The blade holder 3 is pivoted in the opposite direction. It may be desirable for the rear arm 18 of the lock lever assembly 15 to again be depressed manually to assist in unfolding the blade holder 3. The blade holder 3 is continued to be rotated counter-clockwise (as seen in FIG. 4) until the lock finger 19 of the front arm 17 enters into the grove 33 in the rear end 31 of the blade holder 3 in order to hold the blade holder 3 in its extended position.

When it is desired to replace a blade B, the blade holder 3 is placed in its unfolded position (as shown in FIG. 6) and the clip 45 is lifted around pivot 46 by means of finger tab 50 thereby the releasing of guard wall 35 and permitting it to be pivoted downwardly around pivot 36 to expose the blade B. The blade B can then be moved out of the blade holder 3 and a new blade B can be placed therein. The guard wall 35 is again pivoted upwardly back into position over the blade B and the clip 45 is lowered to lock the blade B and the walls 34 and 35 in place.

It will be seen that the present invention provides a utility knife in which the blade holder may be easily folded into a handle in which improved means are provided for securing the blade on the utility knife and for replacing the blade on the knife and which is simple to use and inexpensive to manufacture and maintain.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A utility knife comprises a handle and a blade holder, said blade holder being pivotally mounted on said handle for movement from an unfolded position to a folded position, said handle having a space adapted to receive at least a portion of said blade holder when the blade holder is in its folded position, said blade holder comprising a main wall and a guard wall pivotally mounted on said main wall for movement from an open position to a closed position overlying said main wall, said main wall having means to hold a blade thereon whereby the blade is interposed between said main wall and said guard wall when said guard wall is in its closed position, said blade holder comprises a rear end and a front end, said front end comprising said guard wall and said main wall, said rear end being pivotally mounted to said handle and having upper and bottom edges, said guard wall is pivotally mounted to said main wall on a pivot adjacent the bottom edge of said rear end, a blade lock assembly is mounted for pivotal movement relative to said main and guard walls from an open position to a closed position overlying the main wall and the guard wall, said blade lock assembly is pivotally mounted on said front end adjacent to said upper edge.

2. A utility knife as set forth in claim 1 wherein said blade lock assembly comprises a u-shaped clip having a top wall and a pair of side walls and wherein said side walls straddle said main wall and said guard wall when said clip is in its closed position.

3. A utility knife as set forth in claim 2 wherein said clip has a front finger extending therefrom.

4. A utility knife as set forth in claim 3 wherein said rear end has a finger knob extending therefrom.

5. A utility knife as set forth in claim 4 wherein said handle comprises a pair of spaced handle halves and wherein said handle has a pivoted lock lever assembly mounted in said space in the handle and wherein said lock lever assembly has a front arm and a rear arm and a lock finger extending from the front arm.

6. A utility knife as set forth in claim 5 wherein said rear end of the blade holder has a groove therein adapted to receive said lock finger when the blade holder is in its unfolded position.

7. A utility knife as set forth in claim 6 wherein spring means are mounted beneath the rear arm of the lock lever assembly to bias the rear arm upwardly and to bias the front arm downwardly to permit the lock finger to enter the groove, whereby depressing the rear arm against the tension of the spring means will cause the front arm to rise and the lock finger to move out of the groove permitting the blade holder to pivot relative to the handle from an unfolded position to a folded position into the space in the handle.

8. A utility knife as set forth in claim 7, wherein the handle has a notch in its top edge and wherein the rear arm protrudes above the notch whereby depression of the rear arm at the notch permits the front arm to be raised upwardly and cause the lock finger to move out of the groove.

9. A utility knife as set forth in claim 8, wherein the blade holding means comprise a pair of protrusions on the main wall of the blade holder, said protrusions being adapted to enter corresponding grooves in the blade.

10. A utility knife as set forth in claim 9, wherein inwardly extending pimples are provided on the side walls of said lock assembly to frictionally hold the lock assembly in place.

11. A utility knife comprises a handle and a blade holder, said blade holder being pivotally mounted on said handle for movement from an unfolded position to a folded position, said handle having a space adapted to receive at least a portion of said blade holder when the blade holder is in its folded position, said blade holder comprising a main wall and a guard wall mounted on said main wall and movable from an open position to a closed position overlying said main wall, said main wall having means to hold a blade thereon whereby the blade is interposed between said main wall and said guard wall when said guard wall is in its closed position, said blade holder comprises a rear end and a front end, said front end comprising said guard wall and said main wall, said rear end being pivotally mounted to said handle and having upper and bottom edges, a blade lock assembly is mounted for pivotal movement relative to said main and guard walls from an open position to a closed position overlying the main wall and the guard wall, said blade lock assembly is pivotally mounted on said front end adjacent to said upper edge.

12. A utility knife as set forth in claim 11 wherein said blade lock assembly comprises a u-shaped clip having a top wall and a pair of side walls and wherein said side walls straddle said main wall and said guard wall when a said clip is in its closed position.

13. A utility knife as set forth in claim 12 wherein said clip has a front finger extending therefrom.

14. A utility knife as set forth in claim 13 wherein said rear end has a finger knob extending therefrom.

15. A utility knife as set forth in claim 14 wherein said handle comprises a pair of spaced handle halves and wherein said handle has a pivoted lock lever assembly mounted in said space in the handle and wherein said lock lever assembly has a front arm and a rear arm and a lock finger extending from the front arm.

16. A utility knife as set forth in claim 15 wherein said rear end of the blade holder has a groove therein adapted to receive said lock finger when the blade holder is in its unfolded position.

17. A utility knife as set forth in claim 16 wherein spring means are mounted beneath the rear arm of the lock lever assembly to bias the rear arm upwardly and to bias the front arm downwardly to permit the lock finger to enter the groove, whereby depressing the rear arm against the tension of the spring means will cause the front arm to rise and the lock finger to move out of the groove permitting the blade holder to pivot relative to the handle from an unfolded position to a folded position into the space in the handle.

18. A utility knife as set forth in claim 17, wherein the handle has a notch in its top edge and wherein the rear arm protrudes above the notch whereby depression of the rear arm at the notch permits the front arm to be raised upwardly and cause the lock finger to move out of the groove.

19. A utility knife as set forth in claim 18, wherein the blade holding means comprise a pair of protrusions on the main wall of the blade holder, said protrusions being adapted to enter corresponding grooves in the blade.

20. A utility knife as set forth in claim 19, wherein inwardly extending pimples are provided on the side walls of said lock assembly to frictionally hold the lock assembly in place.

* * * * *